US006301730B1

(12) United States Patent
Delfs et al.

(10) Patent No.: US 6,301,730 B1
(45) Date of Patent: Oct. 16, 2001

(54) HIGH LOFT COMFORTER

(75) Inventors: Juliette M. Delfs; Wing Yee W. Chan, both of Seattle, WA (US)

(73) Assignee: Pacific Coast Feather Company, Seattle, WA (US)

( * ) Notice: Subject to any disclaimer, the term of this patent is extended or adjusted under 35 U.S.C. 154(b) by 0 days.

(21) Appl. No.: 09/474,878

(22) Filed: Dec. 29, 1999

(51) Int. Cl.[7] ..... A47G 9/02
(52) U.S. Cl. ..... 5/502; 5/950; 5/482
(58) Field of Search ..... 5/502, 950, 952, 5/500, 482, 413 R; 112/420, 440

(56) References Cited

U.S. PATENT DOCUMENTS 4,426,945 * 1/1984 A-Yan ..... 5/502
5,987,669 * 11/1999 Leggett et al. ..... 112/475.08

* cited by examiner

*Primary Examiner*—Lynne H. Browne
*Assistant Examiner*—Frederick Conley
(74) *Attorney, Agent, or Firm*—Jensen & Puntingam, P.S.

(57) ABSTRACT

The high loft comforter includes a lower tick portion and an upper tick portion of material, the upper tick portion comprising a plurality of squares arranged and sewn together and then to the lower tick portion, forming rows and columns thereof. Each square has a pleat at each corner thereof, so that when the squares are sewn together and to the lower tick portion, rows and columns of box-like volumes are defined, with approximately straight side portions. Each box volume contains a selected volume of fill, thus providing a high loft, puffy arrangement for the comforter.

5 Claims, 2 Drawing Sheets

FIG. 1
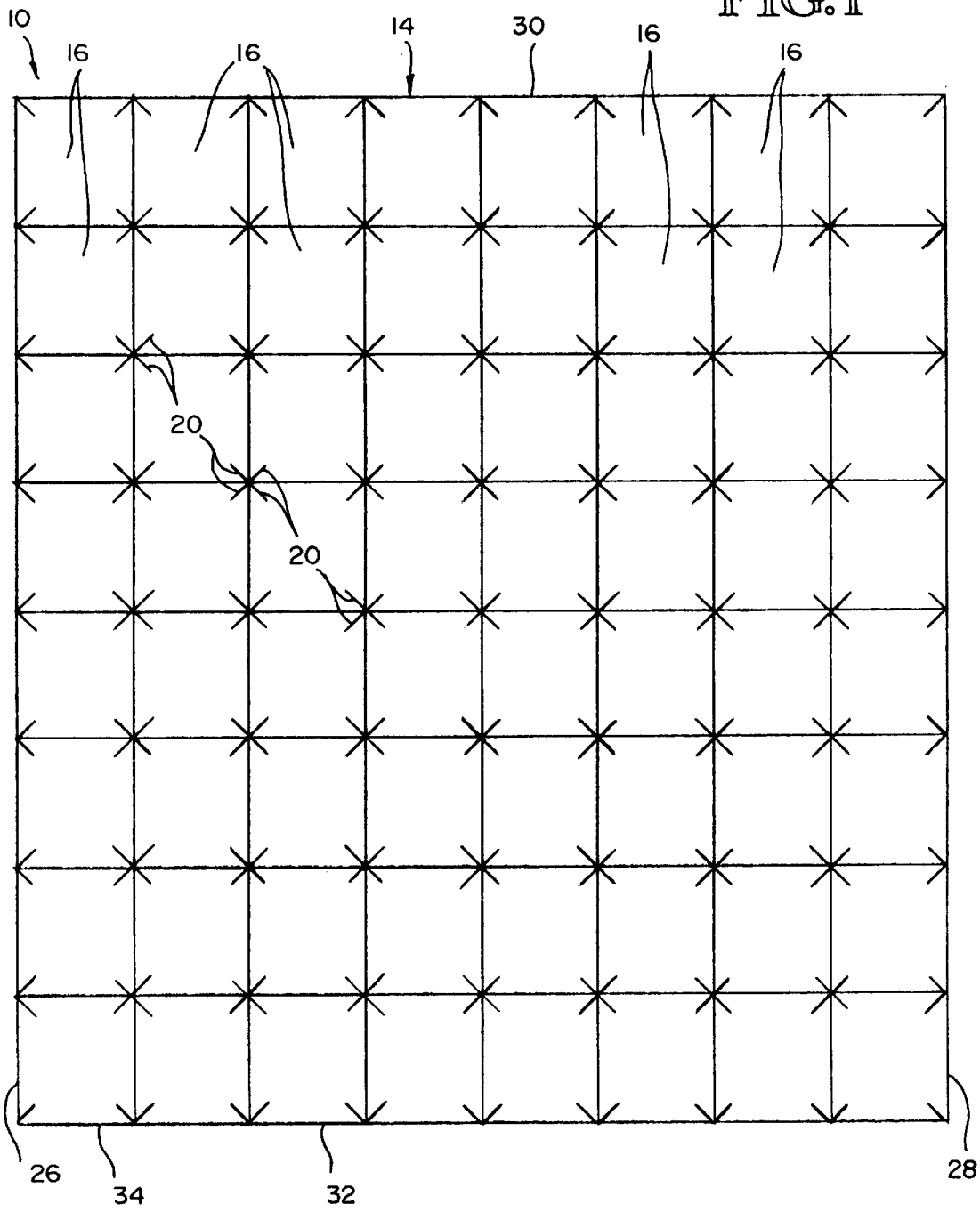
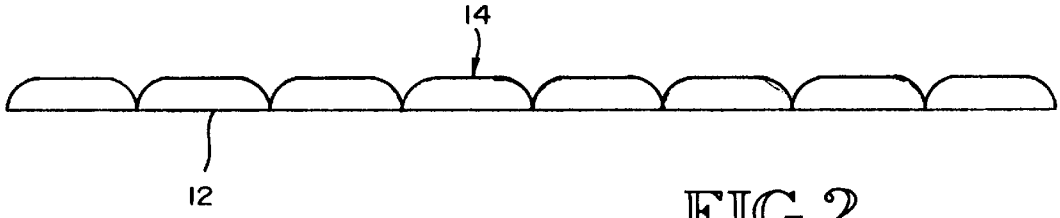
FIG. 2

HIGH LOFT COMFORTER

TECHNICAL FIELD

This invention relates generally to comforters, and more specifically concerns a comforter having a high loft (puffy) structure.

BACKGROUND OF THE INVENTION

One of the important characteristics of a comforter, both for appearance and for comfort, is what is known as "loft". Loft refers to the thickness of the comforter, i.e. the height of the comforter, from the lower layer to the upper layer thereof. Typically, loft is increased by adding additional down to the comforter, giving it a desirable, puffy appearance. The quality and type of down are also factors in loft.

Typical comforter construction includes particular stitching patterns which join the upper and lower cover layers of the comforter, creating channels to hinder migration of the down. This is typically an important aspect of comforter construction. The stitching pattern, however, can decrease the appearance of loft, as the areas between the lines of stitching will appear as rolls or humps with the loft reaching a peak at a midpoint between adjacent stitching lines, instead of a high loft across the entire distance between the lines. A puffy or high loft appearance is thus difficult to obtain with conventional stitching or channeling patterns.

Hence, it is desirable for a comforter to have a puffy or high loft appearance, while also having stitching patterns which effectively prevent migration of the down.

SUMMARY OF THE INVENTION

Accordingly, the present invention is a high loft comforter, which comprises: a lower tick, i.e. cover, portion; and an upper tick portion comprising a plurality of fabric sections arranged and sewn together in a selected pattern, the upper tick portion being larger in surface area than the lower tick portion and attached to the lower tick portion around the periphery thereof, and wherein each section of the upper tick portion is attached to the lower tick portion in a manner as to form individual volumes therebetween, wherein each section has pleats at selected locations on the periphery thereof, so that the loft of the comforter when filled is approximately the same across substantially the entirety of each loft volume.

BRIEF DESCRIPTION OF THE DRAWINGS

FIG. 1 is a top view of the high loft comforter of the present invention.

FIG. 2 is an end view of the comforter of FIG. 1.

BEST MODE FOR CARRYING OUT THE INVENTION

Figure 3:
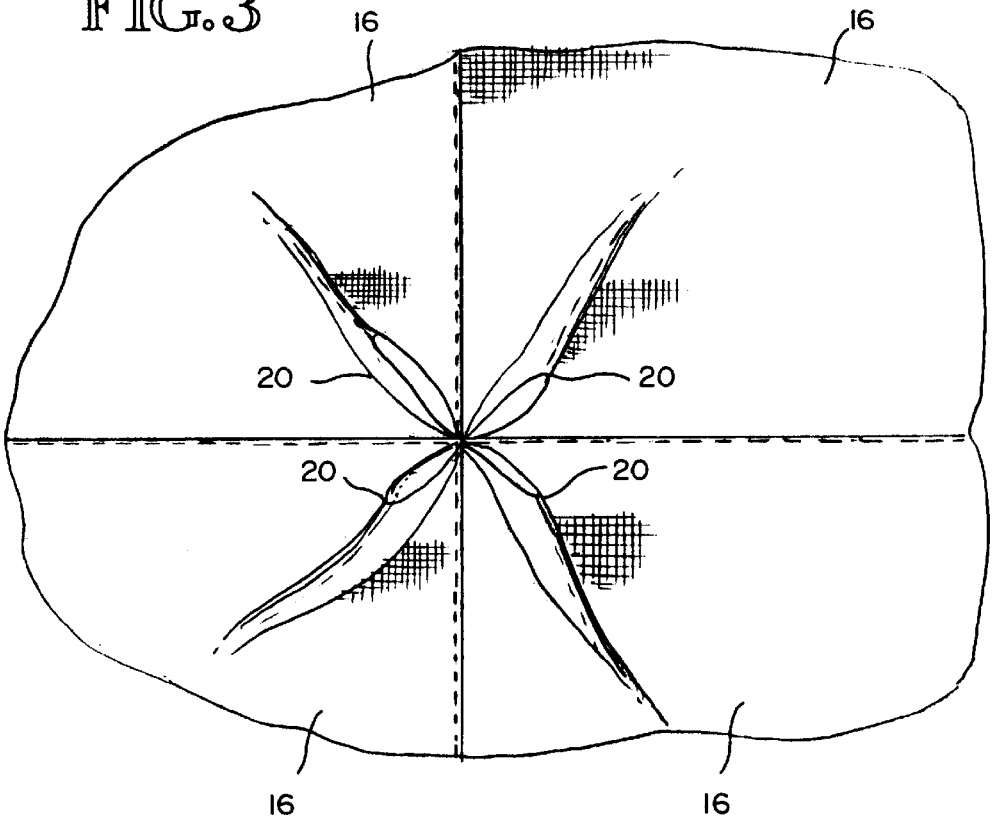
FIG. 3 is a close up of a small portion of the comforter of FIG. 1, showing the pleated construction of the comforter.
Figure 4:
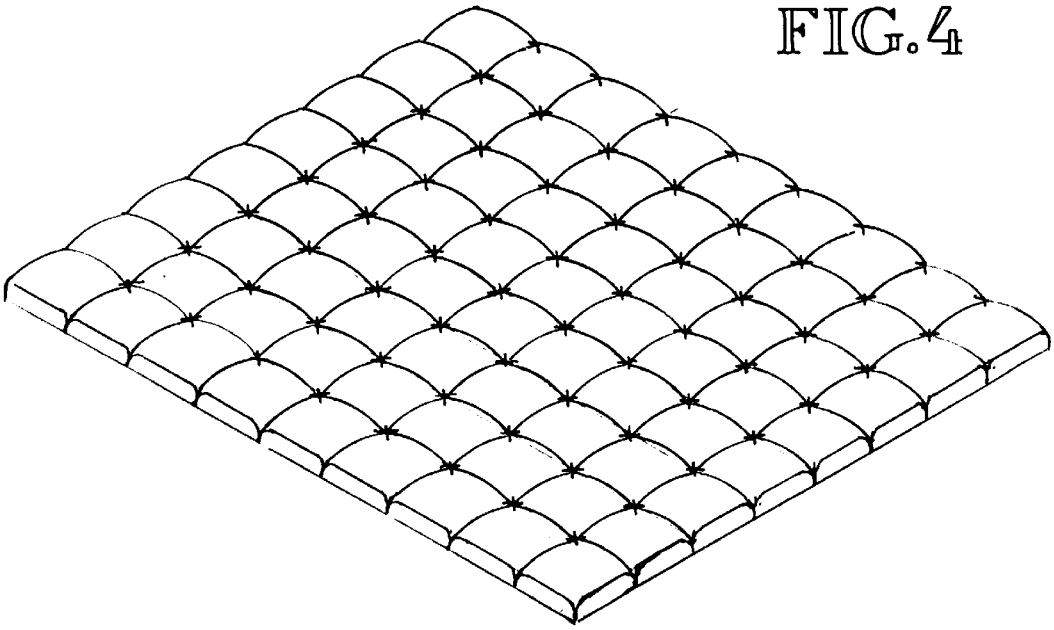
FIG. 4 is a perspective view of the comforter.

FIGS. 1 and 2 show generally the high loft comforter of the present invention, referred to generally at 10. In the embodiment shown, the lower tick portion of the comforter 10 is a fabric 12, such as cotton. An upper tick portion 14, typically of the same fabric, comprises a plurality of individual portions 16-16 of fabric which are cut and then pleated at 20-20 at each corner and sewn together and then sewn as a unit to the lower tick portion, creating a plurality of box-like volumes over the surface area of the comforter.

In one particular embodiment where the comforter is 88 inches wide by 90 inches long, each portion 16 is approximately a square, 11 inches wide by 11.25 inches long, as shown. The number of squares 16 comprising upper tick portion 14 will vary, of course, depending upon the size of the comforter. The individual squares 16, before they are pleated and sewn together, are larger in surface area than the squares after they have been sewn together to form upper layer 14. This oversize surface area permits sufficient fabric to pleat at each corner thereof. For instance, in the above example, with a finished (sewn) square 11 inches by 11.25 inches, the original dimensions (unsewn) of the portion are typically approximately 12 inches by 12 inches.

While the individual sizes of the squares may also vary depending upon the comforter style and size, a typical range will be approximately 9–15 inches. To provide for the required pleating to provide the "box-like" volume structure, the original (unsewn) size of each portion will be in the range of 4–10% larger than the sewn square.

The oversize original squares, when pleated and sewn together and then to the lower tick portion, form in combination the cover for the finished comforter. The comforter is then filled, as described below, to produce a finished product. The pleats 20-20 at each corner of the individual squares permit the corners of each square to rise up almost vertically, so that the comforter has the appearance of a plurality of puffy box-like volumes instead of curved mounds or ribs. Hence, the final appearance of the comforter of the present invention is quite different than a conventional comforter. While the present invention uses square portions, other portion configurations could be used, including rectangular, diamond and various curved shapes. The comforter could also include various border arrangements. All of the portion shapes, however, will include pleats and hence produce three-dimensional volumes having substantially vertical side portions. Again, this increases the height and volume of each portion.

With the comforter of the present invention, all types and quality of down will produce a greater lofting than with conventional comforter ticks. Besides the high loft "puffy" appearance, the insulating capability of the down will increase and become more efficient in the disclosed comforter. An increase in loft is achieved in the comforter of the present invention by virtue of the comforter construction, as opposed to the type and quality of down, which typically controls loft. The present invention can be used in all types and styles of comforters.

The comforter of the present invention is constructed using the following series of steps. As indicated above, the individual squares for the upper tick portion are cut and then pleated at the corners thereof. Pleats could also be made at other points along the periphery of each square if desired. Corner locations are, however, preferred. The individual squares are then sewn together to make the upper tick portion. The lower tick portion is then sewn to the upper tick portion along two sides 26 and 28 and one end 30. The other end 32 of the comforter remains open. A first channel 34 is then sewn along a line for the length of the comforter, i.e. from end 32 to end 30, securing the upper and lower tick portions.

After the first channel 34 is completely sewn, the individual successive boxes or compartments in the channel are created one by one by sewing lateral lines partially across each channel, i.e. from side 26 to side 28, starting at end 30. In the particular embodiment shown, the width of the channel is approximately 11 inches and the distance between each successive lateral line of stitching is 11.25 inches. A small gap in each lateral line of stitching adjacent the channel line is left, however. Each resulting box (compartment) created by the channel and lateral stitching lines is then filled in succession in one channel (e.g. channel 34). When all the boxes in one channel have been filled, the lateral lines of stitching for that channel are sewn completely shut, so that the down present in each box or volume in the channel is fully contained. This same process is repeated for each channel in turn until the entire comforter is completed. Alternatively, the small filling gaps in the lateral lines of stitching could be left open.

As indicated above, the number and size of any of the box-like (or other shape) volumes will vary, depending on the final size of the comforter. The down weight of the comforter will also vary, depending upon the comforter.

The original unsewn sections will, as indicated above, be larger than the final sewn sections by approximately 4–10% in order to give the desired loft. This can be varied to some extent, depending upon the desired height of the loft.

Hence, a comforter construction has been disclosed which adds to, i.e. increases, the puffy appearance (loft) of a comforter, without regard to the particular quality or type of the fill material. The product has a desirable high loft appearance, and the insulating efficiency of the down is increased.

Although a preferred embodiment of the invention has been disclosed here for purposes of illustration, it should be understood that various changes, modifications and substitutions may be incorporated without departing from the spirit of the invention, which is defined by the claims which follow.

What is claimed is:

1. A high loft comforter, comprising:

a lower tick portion; and an upper tick portion comprising a plurality of fabric sections arranged and sewn together in a selected pattern, the upper tick portion being larger in surface area than the lower tick portion and attached to the lower tick portion around the periphery thereof, and wherein each section of the upper tick portion is attached to the lower tick portion in a manner as to form a plurality of separate loft volumes therebetween, wherein each section has pleats at selected locations on the periphery thereof, so that each loft volume, when filled, has a loft which is approximately the same across substantially the entirety of each loft volume.

2. An article of claim 1, wherein the sections are approximately square, and wherein pleats are present at each corner thereof.

3. An article of claim 2, wherein the sections are within a range of 9–15 inches along each side.

4. An article of claim 1, wherein unsewn sections are larger than sewn sections within the range of 4–10%.

5. An article of claim 2, wherein the upper tick portion is secured to the lower tick portion along lines of stitching, longitudinally and laterally.

* * * * *